US005386083A

United States Patent [19]

Kawamura

[11] Patent Number: 5,386,083

[45] Date of Patent: Jan. 31, 1995

[54] KEYBOARD INSTRUMENT HAVING HAMMER STOPPER OUTWARDLY EXTENDING FROM HAMMER SHANK AND METHOD OF REMODELING PIANO INTO THE KEYBOARD INSTRUMENT

[75] Inventor: Kiyoshi Kawamura, Shizuoka, Japan

[73] Assignee: Yamaha Corporation, Japan

[21] Appl. No.: 160,606

[22] Filed: Nov. 30, 1993

[51] Int. Cl.[6] ..... G10C 3/12; G10C 5/00; G10D 15/00; G10H 1/34

[52] U.S. Cl. ..... 84/719; 84/720; 84/171; 84/236; 84/423 R; 84/433; 84/DIG. 7

[58] Field of Search ..... 84/600, 644, 670, 719, 84/720, 744, 745, 171, 236–255, 423 R, 433, DIG. 7

[56] References Cited

U.S. PATENT DOCUMENTS

| | | | |
|---|---|---|---|
| 445,905 | 2/1891 | Rousseau . | |
| 533,661 | 2/1894 | McChesney et al. . | |
| 537,533 | 10/1894 | McChesney et al. . | |
| 2,250,065 | 7/1941 | Koel | 84/171 |
| 4,633,753 | 1/1987 | Takahashi | 84/220 |
| 4,704,931 | 11/1987 | Nagai | 84/1.01 |
| 4,744,281 | 3/1987 | Isozaki | 84/1.28 |
| 4,970,929 | 11/1990 | Ishida | 84/120 |
| 5,001,339 | 3/1991 | Starley et al. . | |
| 5,115,705 | 5/1992 | Monte et al. | 84/617 |
| 5,247,129 | 9/1993 | Nozaki et al. | 84/615 |

FOREIGN PATENT DOCUMENTS

| | | |
|---|---|---|
| 0270966A2 | 6/1988 | European Pat. Off. . |
| 0573963A2 | 12/1993 | European Pat. Off. . |
| 97885 | 10/1897 | Germany . |
| 44782 | 9/1898 | Germany . |
| 3707591C1 | 5/1988 | Germany . |
| T091U000077 | 10/1992 | Italy . |
| 51-67732 | 5/1976 | Japan . |
| 55-55880 | 4/1980 | Japan . |
| 62-173792 | 1/1987 | Japan . |
| 62-32308 | 8/1987 | Japan . |
| 63-97997 | 4/1988 | Japan . |

*Primary Examiner*—Stanley J. Witkowski
*Attorney, Agent, or Firm*—Graham & James

[57] ABSTRACT

A hammer stopper is moved into and outof an orbit of an extension of a hammer shank depending upon an operation mode, and the extension rebounds on the hammer stopper in an electronic sound producing mode between an escape of a jack from a butt and a strike of a hammer head at a set of strings so that a player performs a music through synthesized sounds without sacrifice of the piano key-touch.

15 Claims, 7 Drawing Sheets

KEYBOARD INSTRUMENT HAVING HAMMER STOPPER OUTWARDLY EXTENDING FROM HAMMER SHANK AND METHOD OF REMODELING PIANO INTO THE KEYBOARD INSTRUMENT

FIELD OF THE INVENTION

This invention relates to a keyboard instrument and, more particularly, to a keyboard instrument selectively producing acoustic sounds and synthesized sounds.

DESCRIPTION OF THE RELATED ART

A piano gives a unique touch to a player, and an electronic keyboard synthesizer does not exactly imitates the unique key-touch, and an attempt was made on a compromise between a piano and an electronic synthesizer.

The compromise or the piano-like musical instrument has key action mechanisms coupled between the keyboard and the hammer assemblies and a tone generator system, and sounds are synthesized by the tone generator system. However, the key action mechanisms drives the hammer assemblies for striking the strings, and gives the unique key-touch to the player.

However, when a hammer strikes the strings, the strings vibrate, and produce an acoustic sound. The acoustic sound is mixed with the synthesized sound, and an audience feels the mixed sounds strange.

A muting mechanism incorporated in a grand piano is disclosed in Japanese Publication of Unexamined Utility Model Application (Kokai) No. 51-67732, and the muting mechanism restricts a hammer motion by means of a resilient member. According to the Japanese Publication of Unexamined Utility Model Application, the hammer concurrently strikes the resilient member and the associated strings, and the impact is split between the resilient member and the strings. As a result, the strings weakly vibrate, and the sound is lessened.

The prior art piano-like keyboard instruments can decrease the loudness of acoustic sounds. However, the prior art piano-like keyboard instruments can not perfectly eliminate the acoustic sounds from electrically synthesized sounds.

If the resilient member is moved to a closer position to the home position of the hammer, the hammer strikes the resilient member only, and the acoustic sound is not produced. However, the resilient member closer to the home position does not allow the jack to escape from the butt, and the key action mechanism can not give the unique key touch to the player.

If the hammer is removed, the strings never vibrate, and acoustic sounds are not mixed with the synthesized sounds. However, the keys are too light to give an appropriate resistance against the fingers of the player, and the key action mechanisms without hammers can not imitate the unique key-touch.

Thus, there is a trade-off between the acoustic sounds and the key-touch, and all of the prior art keyboard instruments do not satisfy players.

SUMMARY OF THE INVENTION

It is therefore an important object of the present invention to provide a keyboard instrument which gives the unique key-touch to a player without acoustic sounds.

It is another important object of the present invention to provide a method of remodeling a piano into a keyboard instrument selectively entering into a mechanically sound producing mode and an electronically sound producing mode without acoustic sounds.

To accomplish the object, the present invention proposes to interrupt the rotational of a hammer before an associated hammer strikes strings.

In accordance with one aspect of the present invention, there is provided a keyboard instrument selectively entering a mechanical sound producing mode and an electronic sound producing mode, comprising: a) an acoustic piano including a-1) a keyboard having a plurality of keys turnable with respect to a stationary board member, the plurality of keys being selectively depressed in both mechanical and electronic sound producing modes by a player, a-2) a plurality of key action mechanisms respectively coupled with the plurality of keys, and selectively actuated by the plurality of keys when the player depresses, a-3) a plurality of hammer mechanisms respectively associated with the plurality of key action mechanisms, and having respective hammer shanks and respective hammer heads projecting from leading end portions of the hammer shanks substantially in normal with respect to the hammer shanks, respectively, the plurality of key action mechanisms being driven for rotation by the plurality of key action mechanisms when the player selectively depresses the plurality of keys, and a-4) a plurality of strings associated with the plurality of hammer mechanisms, and struck by the hammer heads in the mechanical sound producing mode when the player selectively depresses the plurality of keys; b) an electronic sound producing means deciding what keys are depressed by the player in the electronic sound producing mode, and operative to electronically produce sounds corresponding to the keys depressed by the player; and c) a controlling means having a plurality of extensions radially outwardly extending with respect to the leading end portions of the shammer shanks, respectively, a movable stopper moved into and outof orbits of the extensions, and a driver unit responsive to an instruction of the player for driving the movable stopper between a free position in the mechanically sound producing mode and a blocking position in the electronically sound producing mode, the extensions being freely moved together with the associated hammer mechanisms without an interruption of the movable stopper while the movable stopper is staying in the free position, the extensions being brought into contact with the movable stopper in the blocking position before the associated hammer heads strike the plurality of strings.

In accordance with another aspect of the present invention, there is provided a method of remodeling a piano into a keyboard instrument selectively entering into a mechanically sound producing mode and an electronically sound producing mode, comprising the steps of: a) preparing a piano which comprises a keyboard having a plurality of keys turnable with respect to a stationary board member, the plurality of keys being selectively depressed in both mechanical and electronic sound producing modes by a player, a plurality of key action mechanisms respectively coupled with the plurality of keys, and selectively actuated by the plurality of keys when the player depresses, a plurality of hammer mechanisms respectively associated with the plurality of key action mechanisms, and having respective hammer shanks and respective hammer heads projecting from leading end portions of the hammer shanks substantially in normal with respect to the hammer shanks, respectively, the plurality of key action mechanisms being driven for rotation by the plurality of key action mechanisms when the player selectively depresses the plurality of keys, and a plurality of strings associated with the plurality of hammer mechanisms, and struck by the hammer heads in the mechanical sound producing mode when the player selectively depresses the plurality of keys; and b) adding an electronic sound producing means and a controlling means, the electronic sound producing means being operative to decide what keys are depressed by the player in the electronic sound producing mode for electronically producing sounds corresponding to the keys depressed by the player, the controlling means having a plurality of extensions attached to the plurality of hammer mechanisms in such a manner as to radially outwardly project therefrom, a movable stopper moved into and outof orbits of the extensions, and a driver unit responsive to an instruction of the player for driving the movable stopper between a free position in the mechanically sound producing mode and a blocking position in the electronically sound producing mode, the extensions being freely moved together with the associated hammer mechanisms without an interruption of the movable stopper while the movable stopper is staying in the free position, the extensions being brought into contact with the movable stopper in the blocking position before the associated hammer heads strike the plurality of strings.

BRIEF DESCRIPTION OF THE DRAWINGS

The features and advantages of the keyboard instrument and the method according to the present invention will be more clearly understood from the following description taken in conjunction with the accompanying drawings in which.

DESCRIPTION OF THE PREFERRED EMBODIMENTS

First Embodiment

Figure 1:
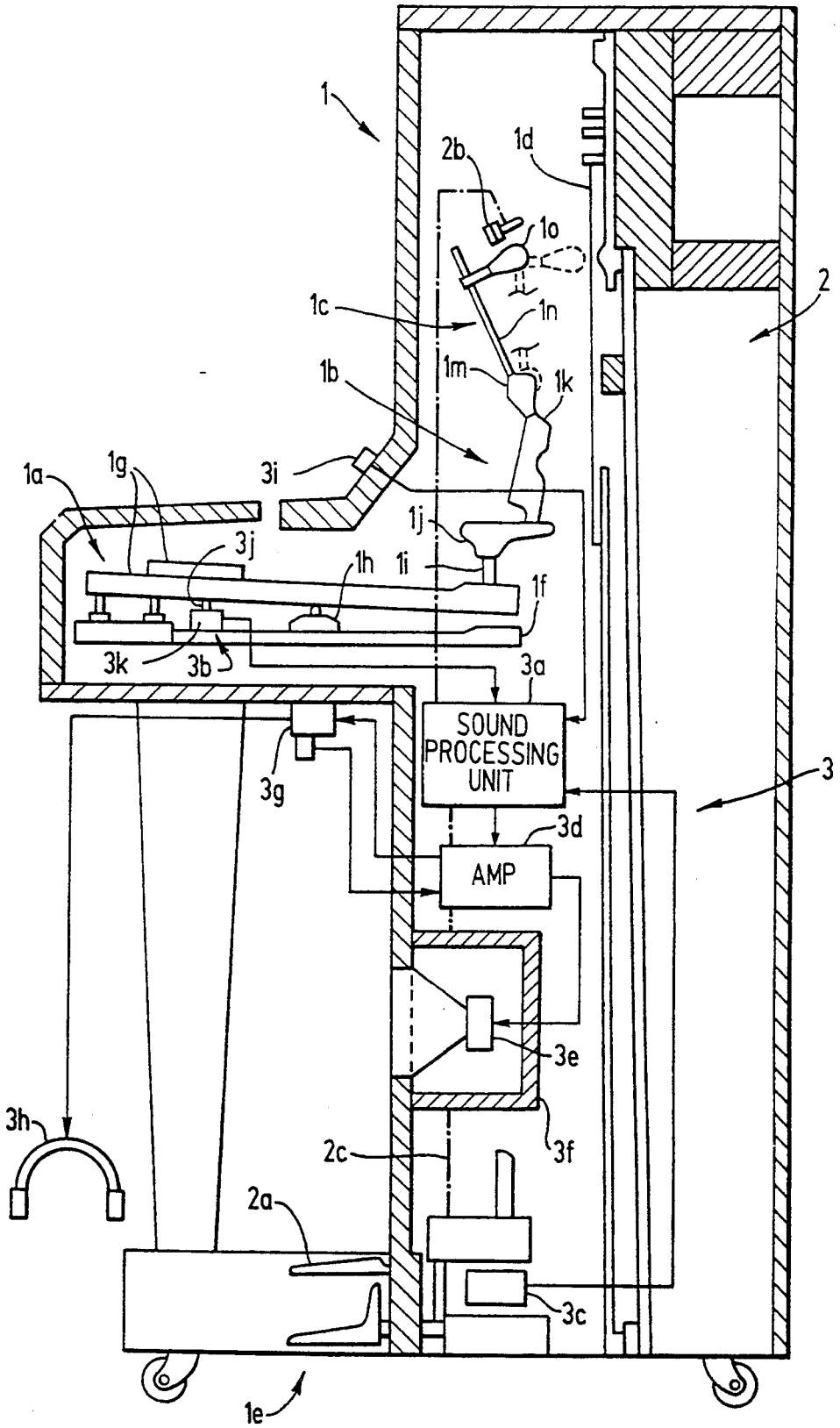
FIG. 1 is a side view showing the structure of a keyboard instrument according to the present invention.
Figure 2:
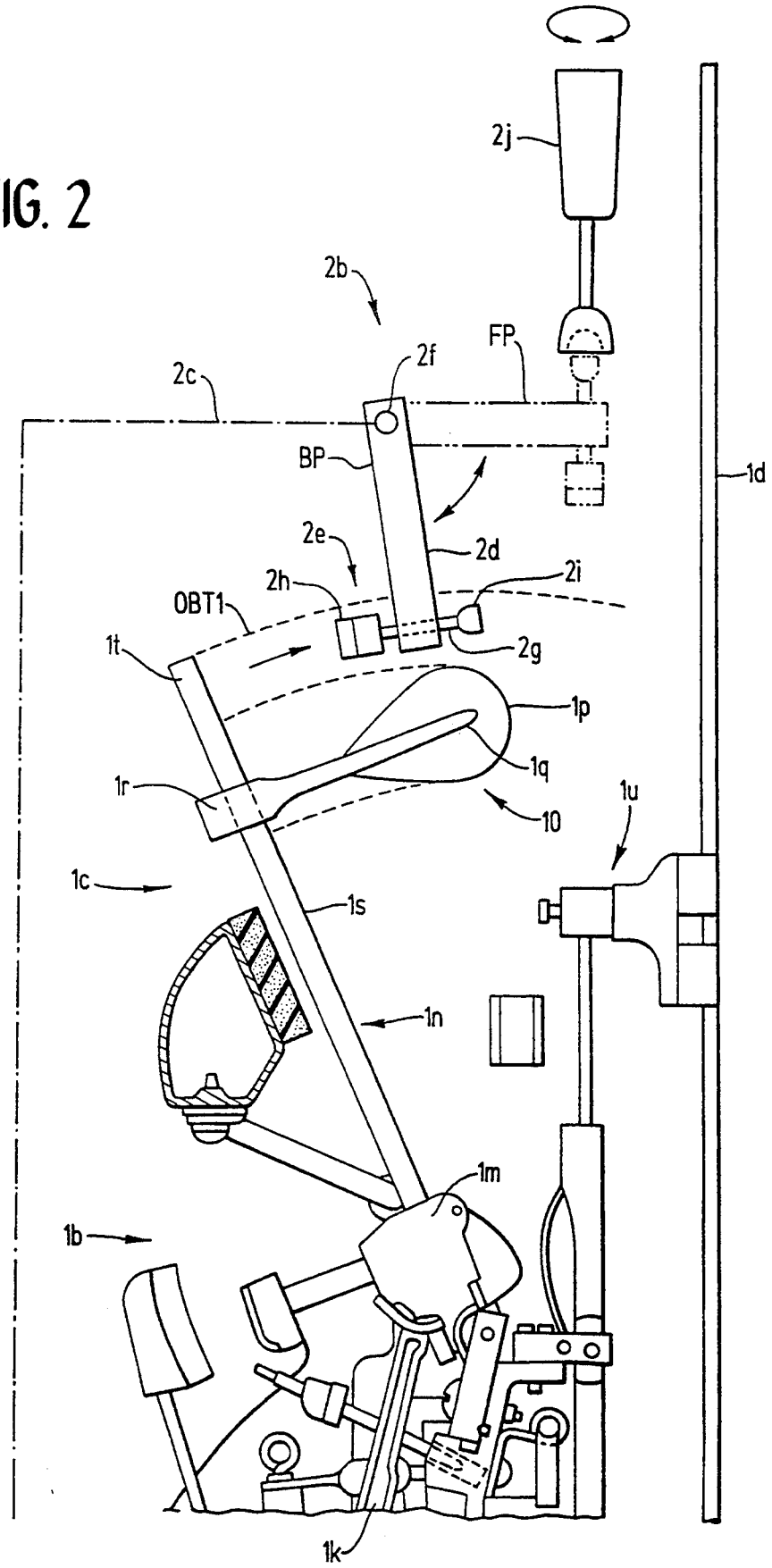
FIG. 2 is a side view showing a hammer stopper associated with a hammer mechanism incorporated in the keyboard instrument.

Referring first to FIGS. 1 and 2 of the drawings, a keyboard instrument embodying the present invention largely comprises an acoustic piano 1, a silent system 2 and an electronic sound generating system 3, and selectively enters a mechanical sound producing mode and an electronic sound producing mode. In this instance, the silent system serves as a controlling means.

While staying in the mechanical sound producing mode, the keyboard instrument serves as an acoustic upright piano, and not only the sounds but also the key-touch are identical with those of the acoustic upright piano. On the other hand, the keyboard instrument electrically synthesizes sounds in response to keying-in, and the acoustic sounds are not produced in the electronic sound producing mode. In this instance, the acoustic piano 1 is of the upright type. However, the acoustic piano 1 may be of a grand type.

The acoustic piano 1 comprises a keyboard 1*a*, a plurality of key action mechanisms 1*b*, a plurality of hammer mechanisms 1*c*, a plurality sets of strings 1*d* and a pedal mechanism 1*e*. The keyboard 1*a* is mounted on a key bed 1*f*, and is implemented by black and white keys 1*g*. In this instance, the key bed 1*f* serves as a stationary board member. The black and white keys 1*g* are turnable with respect to balance pins embedded in a balance rail 1*h*. The key action mechanisms 1*b* are respectively linked with the rear ends of the black and white keys 1*g*, and drive the hammer mechanisms 1*c* for rotation when the associated keys 1*g* are depressed.

Each of the key action mechanisms 1*b* comprises a capstan button 1*i* projecting from the rear end of the associated key, an whippen 1*j* held in contact with the capstan button 1*i* and a jack 1*k* provided on the whippen 1*j*, and the jack 1*k* exerts a force on the associated hammer mechanism for rotation.

Each of the hammer mechanisms 1*c* comprises a butt 1*m* kicked by the jack 1*k*, a hammer shank 1*n* implanted in the butt 1*m* and a hammer head 1*o* coupled with the leading end of the hammer shank 1*n*. The hammer shank 1*n* is formed of maple or the like, and the hammer head 1*o* is implemented by a hammer felt 1*p* attached to a hammer wood 1*q*. A hole 1*r* is formed in a boss portion of the hammer wood 1*q*, and the hammer shank 1*n* passes through the hole 1*r* in such a manner as to be substantially normal with respect to the shammer head 1*o*. The portion of the hammer shank 1*n* between the butt 1*m* and the hammer wood 1*q* is referred to a hammer shank portion 1*s* corresponding to a hammer shank of an upright piano, and the portion projecting from the hammer wood 1*q* is called as an extension 1*t*.

When the jack 1*k* kicks the butt 1*m*, the butt 1*m* and, accordingly, the hammer head 1*o* are driven for rotation toward the associated strings 1*d*, and the hammer head 1*o* strikes the strings 1*d* so that the strings 1*d* vibrate for producing an acoustic sound.

The pedal mechanism 1*e* usually have three pedals and three pedal link sub-mechanisms respectively associated with the pedal. One of the pedal is called as a damper pedal, and allows the strings 1*d* to prolong the sound. The second pedal is called as a soft pedal, and causes the hammer heads 1*o* to strike fewer than the normal number of strings for lessening the volume. The last pedal is called as a sostenuto pedal, and enables selected notes to be sustained independently from the others.

A damper mechanism 1u is associated with each set of strings 1d, and is left from the set of strings 1d before an impact of the hammer head 1o.

The key action mechanisms 1b, the hammer mechanisms 1c, the damper mechanisms 1u and the pedal mechanism 1e are analogous to those of an upright piano, and are well known to a person skilled in the art. For this reason, no further description is incorporated hereinbelow for the sake of simplicity.

The silent system 2 comprises a pedal 2a a rotatable stopper 2b, a link mechanism 1c and the plurality of extensions 1t. The pedal 2a is manipulated by a player, and is shifted between a rest position and a depressed position.

Though not shown in the drawings, a step portion is formed in a lower front board, and the pedal 2a is caught by the step portion so as to maintain the pedal 2a at the depressed position. While the pedal 2a is in the rest position, the rotatable stopper 2b is outof an orbit OBT1 of the extensions 1t, and is kept in a free position FP. For this reason, the hammer heads 1o strike the sets of strings 1d without any interruption of the rotatable stopper 2b, and the player performs a music in the mechanical sound producing mode.

On the other hand, if the player steps on the pedal 2a, the pedal 2a is shifted from the rest position to the depressed position, and the rotatable stopper 2b is moved into the orbit OBT1 of the extension. However, the rotatable stopper 2b is still out of an orbit OBT2 of the hammer heads 1o. If the player depresses one of the keys 1g, the extension 1t is brought into contact with the rotatable stopper 2b thus entering into a blocking position BP after the escape of the jack 1k, and rebounds on the rotatable stopper 2b before an impact of the hammer head 1o.

The rotatable stopper 2b comprises a stopper rail 2d shared between all of the hammer mechanisms 1c, a plurality of stoppers 2e respectively associated with the hammer mechanisms 1c and a rod member 2f. The rod member 2f is connected with the link mechanism 2c, and is driven for rotation together with the stopper rail 2d. The stopper 2e is analogous to a regulating button, and comprises a screw member 2g and a cushion member 2h attached to a head of the screw member 2g. The cushion member 2h is formed of felt or leather, and absorbs the impact of the extension 1t.

A male screw is formed on the outer surface of the screw member 2g, and is engaged with a female screw formed in the stopper rail 2d. A suitable coupling 2i is connected with the screw member 2g, and the screw member 2g and the cushion member 2h are turnable with a tool 2j inserted into the coupling 2i.

A tuner regulates distances between the cushion members 2h and the associated extensions with the tool 2j, and the distances are adjusted in such a manner that the jacks 1k escape from the associated butts 1m and that the extensions 1t rebound on the cushion members 2h before impacts of the associated hammer heads 1o at the strings 1d. For this reason, the key action mechanisms give the piano key-touch to the player in the electronically sound producing mode without acoustic sound, and the distances are not less than the distances between the toes of the jacks 1k and the regulating buttons (not shown). The distances between the toes and the regulating buttons are about 3 millimeters for low-pitched tones, 2.5 millimeters for middle pitched tones and 2 millimeters for high pitched tones.

Turning back to FIG. 1, the electronic sound generating system 3 comprises a sound processing unit 3a, a plurality of key sensors 3b, a plurality of pedal sensors 3c, an amplifier unit 3d, a speaker system 3e housed in a speaker box 3f, a socket unit 3g, a headphone 3h detachable from the socket unit 3g and a switch unit 3i, and is activated in the electronic sound producing mode through the switch unit 3i.

The plurality of key sensors 3b are respectively associated with the keys 1g, and each of the key sensors 3b comprises a shutter plate 3j fixed to the bottom surface of the associated key and a photo-interrupter 3k monitoring the shutter plate 3j. Four different patterns are formed in the shutter plate 3j , and the four patterns sequentially passes through an optical path produced by the photo interrupter 3k when the associated key is depressed. Time intervals between the four patterns are reported from the photo interrupter 3k to the sound processing unit 3a, and the sound processing unit 3a determines the key velocity and estimates the time when the associated hammer head 1o strikes the strings 1d.

The pedal sensors 3c monitor the three pedal to see whether or not the player steps on the three pedals. If the player steps on one of the pedal, the associated pedal sensor 3c detects the motion of the pedal, and report the depressed pedal to the sound processing unit 3a.

The sound processing unit 3a sequentially scans input ports assigned to the switch unit 3i, the key sensors 3b and the pedal sensors 3c in the electronic sound producing mode. If the switch unit 3i is manipulated again, the keyboard instrument returns to the mechanical sound producing mode, and the sound processing unit 3a does not produce analog sound signal from sets of pcm (Pulse Code Modulation) data codes.

On the other hand, the sound processing unit 3a is responsive to detecting signals from the key sensors 3b and the pedal sensors 3c for producing the analog sound signals. If one of the keys 1g is depressed by the player, the key sensor 3b supplies the detecting signal indicative of the key motion, and a set of pcm data are fetched for data processing. An analog sound signal is produced from the pcm data codes, and is supplied to the amplifier unit 3d. The amplifier unit 3d drives the speaker system 3e or the headphone 3h.

The arrangement of the sound processing unit 3a is disclosed in U.S. Ser. No. 08/073,092 filed on Jun. 7, 1993, and no further description is incorporated hereinbelow for the sake of simplicity.

Assuming now that a player starts fingering on the keyboard 1a in the mechanical sound producing mode, the player depresses one of the keys in the performance, and the capstan button 1i pushes up the whippen 1j. The whippen 1j allows the jack 1 to rotate the butt 1m and the hammer mechanism 1c in the clockwise direction in FIG. 2; however, the regulating button restricts the motion of the jack 1k, and the whippen 1j compresses a jack spring. When the jack spring is sufficiently compressed, the resilient force accumulated in the jack spring allows the jack 1k to escape from the butt 1m, and the jack 1k kicks the butt 1m for rotating in the clockwise direction at high speed. The pedal 2a remains in the rest position, and the link mechanism 2c keeps the rotatable stopper 2b outof the orbit OBT1. For this reason, the hammer head 1o reaches the set of strings 1*d*, and rebounds thereon. The strings 1*d* vibrates, and the acoustic sound is produced.

The hammer head 1*o* rotates in the counter clockwise direction, and the key released from the end position allows a catcher to be brought into contact with a back check. Then, the key action mechanism 1*b* and the hammer mechanism 1*c* return to the respective home positions.

On the other hand, if the player steps on the pedal 2*a*, the link mechanism 2*c* rotates the stopper rail 2*d* in the clockwise direction, and the stoppers 2*e* enter the blocking position. If the player depresses the key 1*g*, the capstan button 1*i* pushes up the whippen 1*j*, and the jack 1*k* rotates the butt 1*m* in the clockwise direction. When the toe is brought into contact with the regulating button, the whippen 1*j* compresses the jack spring, and jack spring causes the jack 1*k* to escape from the butt 1*m*. As a result, the key action mechanism 1*b* gives the piano key touch to the player.

After the escape, the butt 1*m* and the hammer head 1*o* turns toward the set of strings 1*d*. However, extension 1*t* is brought into contact with the stopper 2*e* on the way to the strings 1*d*, and rebounds on the stopper 2*e* without strike at the strings 1*d*. The key released from the end position allows the back check to be brought into contact with the catcher, and the key action mechanism 1*b* and the hammer mechanism 1*c* return to the respective home positions.

As will be appreciate from the foregoing description, the rotatable stopper 2*b* is moved into and outof the orbit of the extension 1*t*, and allows a player to perform a music in the mechanical sound producing mode or the electronic sound producing mode without sacrifice of the piano key-touch.

Second Embodiment

Figure 3:
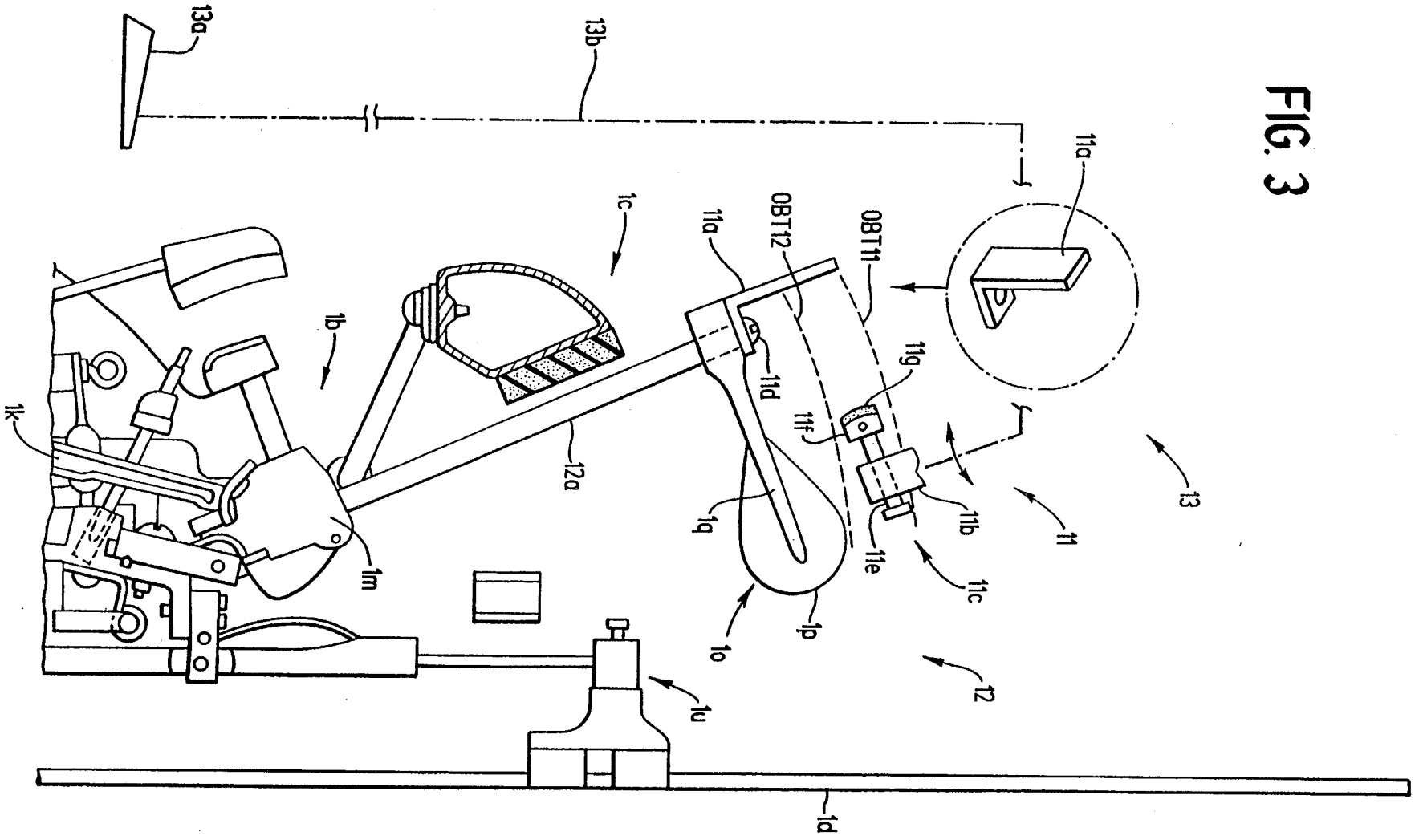
FIG. 3 is a side view showing a hammer stopper incorporated in another keyboard instrument according to the present invention.

Turning to FIG. 3 of the drawings, a hammer stopper 11 is incorporated in another keyboard instrument embodying the present invention. The keyboard instrument implementing the second embodiment largely comprises an acoustic piano 12, a silent system 13 and an electronic sound generating system (not shown), and selectively enters into a mechanical sound producing mode and an electronic sound producing mode.

The acoustic piano 12 is of the upright type, and is similar to the acoustic piano 1 except for hammer shanks 12*a*. For this reason, the other component parts are labeled with the references designating the corresponding parts of the acoustic piano 1 without detailed description. In this instance, the hammer shanks 12*a* are inserted to the hammer woods 1*q*, and are fixed thereto.

The electronic sound generating system is similar to that of the first embodiment, and no further description is incorporated hereinbelow for the sake of simplicity.

The silent system 13 largely comprises a pedal 13*a*, a link mechanism 13*b* and the hammer stopper 11. The pedal 13*a* is manipulated by a player, and is caught by a step portion of a board (not shown) incorporated in the acoustic piano 12 for keeping at manipulated state. The link mechanism 13*b* is connected between the pedal 13*a* and the hammer stopper 11, and causes the hammer stopper 11 to change the position.

Namely, while the pedal 13*a* is in the manipulated state, the link mechanism 13*b* changes the hammer stopper 11 from a free position to a blocking position, and the hammer stopper 11 blocks the strings from the hammer heads 1*o* as will be described in detail hereinlater.

On the other hand, when the pedal 13*a* is released from the manipulated position, the link mechanism 13*b* allows the hammer stopper 11 to return from the blocking position to the free position, and the hammer heads 1*o* strike the associated strings 1*d* without interruption of the hammer stopper 11.

The hammer stopper 11 comprises a plurality of detachable bracket members 11*a* bolted to the hammer woods 1*q*, a stopper rail 11*b* connected with the link mechanism 13*b* and a plurality of stoppers 11*c* supported by the stopper rail 11*b*. If the leading ends of the hammer shanks 12*a* are exposed to the upper surfaces of the hammer woods 1*q*, the bracket members 11*a* may be bolted to the leading ends of the hammer shanks 12*a*.

The detachable bracket members 11*a* are shaped into a generally L-shape configuration, and bolts 11*d* fix the detachable bracket members 11*a* to the hammer woods 1*q*. For this reason, the detachable bracket members 11*a* radially outwardly project from the hammer woods 1*q*, and respectively trace orbits OBT11 while the hammer heads 1*o* rotate toward the strings 1*d* along the orbits OBT12. There is the blocking position of the hammer stopper 11 between the orbits OBT12 of the hammer heads 1*o* and the orbits OBT11 of the detachable bracket members 11*a*. On the other hand, the free position of the hammer stopper 11 is outof the orbits OBT11, and not only the hammer mechanisms 1*c* but also the detachable bracket members 11*a* are not brought into contact with the stoppers 11*c*.

Each of the stoppers 11*c* comprises a threaded stem portion 11*e* engaged with a female screw formed in the stopper rail 11*b*, a head portion 11*f* integral with the treaded stem portion 11*e* and a cushion member 11*g* attached to the head portion 11*f*. The treaded stem portion 11*e* is turnable by means of a tool (not shown), and the distance between the detachable bracket members 11*a* and the cushion members 11*g* are regulated to predetermined values as similar manner to the first embodiment. In this instance, the silent system 11 serves as a controlling system, and the detachable bracket members 11*a* as extensions.

The behavior of the keyboard instrument implementing the second embodiment is similar in both mechanical and electronic sound producing modes to the first embodiment, and description on the behavior is omitted for avoiding repetition.

Description in hereinbelow made on a method of remodeling an upright piano into the keyboard instrument according to the present invention. The upright piano is similar to that of the acoustic piano 12, and the keyboard 1*a*, the key action mechanisms 1*b*, the hammer mechanisms 1*c*, the sets of strings 1*d*, the pedal mechanism 1*e* and the damper mechanisms 1*u* are incorporated therein. The hammer shanks 12*a* form parts of the hammer mechanisms 1*c* instead of the hammer shanks 1*n*, and are standard parts of the upright piano.

The remodeling method starts with preparation of the silent system 13 and the electronic sound producing system, and the silent system 13 and the sound processing system are added to the upright piano. Namely, the sound processing unit 3*a*, the amplifier unit 3*d*, the speaker system 3*e* housed in the speaker box 3*f* and the link mechanism 13*b* are installed in vacant space inside the upright piano, and the socket unit 3*g* and the switch unit 3*i* are attached to suitable board members of the upright piano. The switch unit 3*i* may be linked with the link mechanism 13*b*, and is automatically manipulated by the player together with the pedal 13*a*.

The detachable bracket members 11*a* are respectively bolted to the hammer woods 1*q*, and the stopper rail 11*b* is connected with the link mechanism 13*b*. The stoppers 11*c* have been already screwed in the stopper rail 11*b* at spacings, and, for this reason, are installed together with the stopper rail 11*b*. A tuner regulates distances between the bracket members 11*a* and the cushion members 11*g* to the predetermined values, and the remodeling is completed.

Thus, any component part of an upright piano is not changed, and the silent system 11 is desirable for the remodeling.

Third Embodiment

Figure 4:
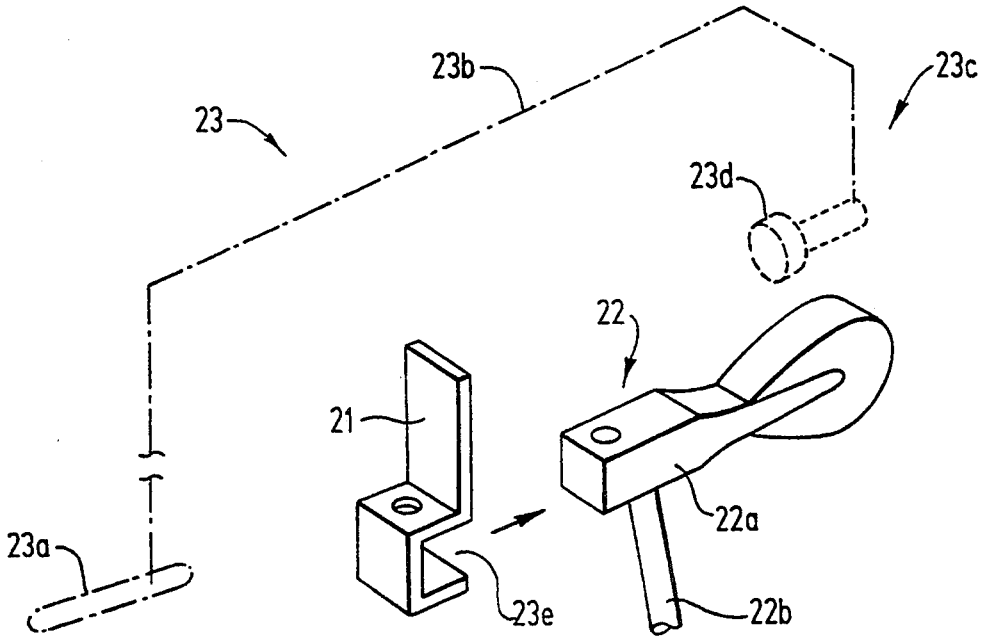
FIG. 4 is a perspective view showing disassembled state of a detachable bracket member incorporated in yet another keyboard instrument according to the present invention.

Turning to FIG. 4 of the drawings, a detachable bracket member 21 is separated from a hammer head incorporated in yet another keyboard instrument embodying the present invention. The keyboard instrument implementing the third embodiment largely comprises an acoustic piano, a silent system 23 and an electronic sound generating system (not shown), and selectively enters into a mechanical sound producing mode and an electronic sound producing mode.

The acoustic piano and the electronic sound generating system are similar to those of the second embodiment, and no further description is incorporated hereinbelow for the sake of simplicity.

The silent system 23 largely comprises a pedal 23*a*, a link mechanism 23*b* and a hammer stopper 23*c*. The pedal 23*a* is manipulated by a player, and is caught by a suitable retainer on a board member incorporated in the acoustic piano for keeping at manipulated state. The link mechanism 23*b* is connected between the pedal 23*a* and the hammer stopper 23*c*, and causes the hammer stopper 23*c* to change the position.

Namely, while the pedal 23*a* is in the manipulated state, the link mechanism 23*b* changes the hammer stopper 23*c* from a free position to a blocking position, and the hammer stopper 23*c* blocks the strings from the hammer heads as will be described in detail hereinlater.

On the other hand, when the pedal 23*a* is released from the manipulated position, the link mechanism 23*b* allows the hammer stopper 23*c* to return from the blocking position to the free position, and the hammer heads strike the associated strings without interruption of the hammer stopper 23*c*.

The hammer stopper 23*c* has a plurality of detachable bracket members 21 bolted to hammer woods 22*a* and a plurality of stoppers 23*d* driven by the link mechanism 23*b*. Each of the detachable bracket members 21 is bent at the right angle three times for forming a pocket portion 23*e*, and the hammer wood 22*a* is snugly received into the pocket portion 23*e*. As a result, the detachable bracket member 21 radially outwardly projects from the hammer wood 22*a*.

Figure 5:
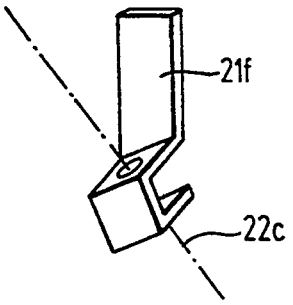
FIG. 5 is a perspective view showing a detachable bracket member for a hammer mechanism assigned a low-pitched tone.

The hammer shanks 22*b* assigned low-pitched tones are usually oblique, and the detachable bracket members 21 for the low-pitched tones decline with respect to the center axis 22*c* of the leading end portions of the hammer shanks 22*b* as shown in FIG. 5.

Figure 6:
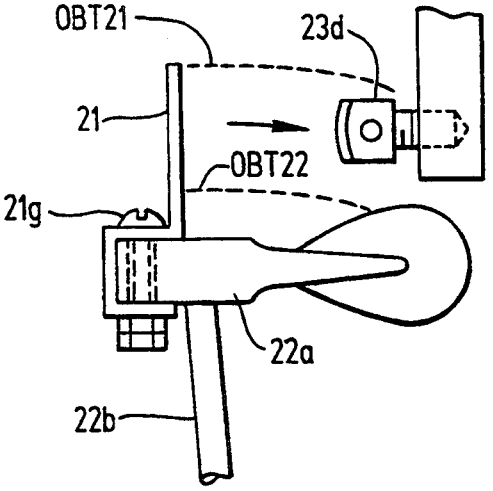
FIG. 6 is a side view showing the detachable bracket member assembled with the hammer mechanism.

Bolts 21*g* fix the detachable bracket members 21 to the hammer woods 22*a* as shown in FIG. 6, and the detachable bracket members 21 rotate together with the hammer woods 22*a*. The leading ends of the detachable bracket members 21 respectively trace orbits OBT21 while the hammer heads 22 rotate toward the strings along the orbits OBT22.

The blocking position of the hammer stopper 23 is between the orbits OBT22 of the hammer heads 22 and the orbits OBT21 of the detachable bracket members 21. On the other hand, the free position is outof the orbits OBT21, and not only the hammer heads 22 but also the detachable bracket members 21 are not brought into contact with the stoppers 23*d* in the free position.

The behavior of the keyboard instrument implementing the third embodiment is similar in both mechanical and electronic sound producing modes to the first and second embodiments, and an upright piano is remodeled to the keyboard instrument implementing the third embodiment through the method described in connection with the second embodiment. Since the bolts 21*g* are turnable by an operator on the keyboard side, the remodeling work is easier than that of the second embodiment.

Fourth Embodiment

Figure 7:
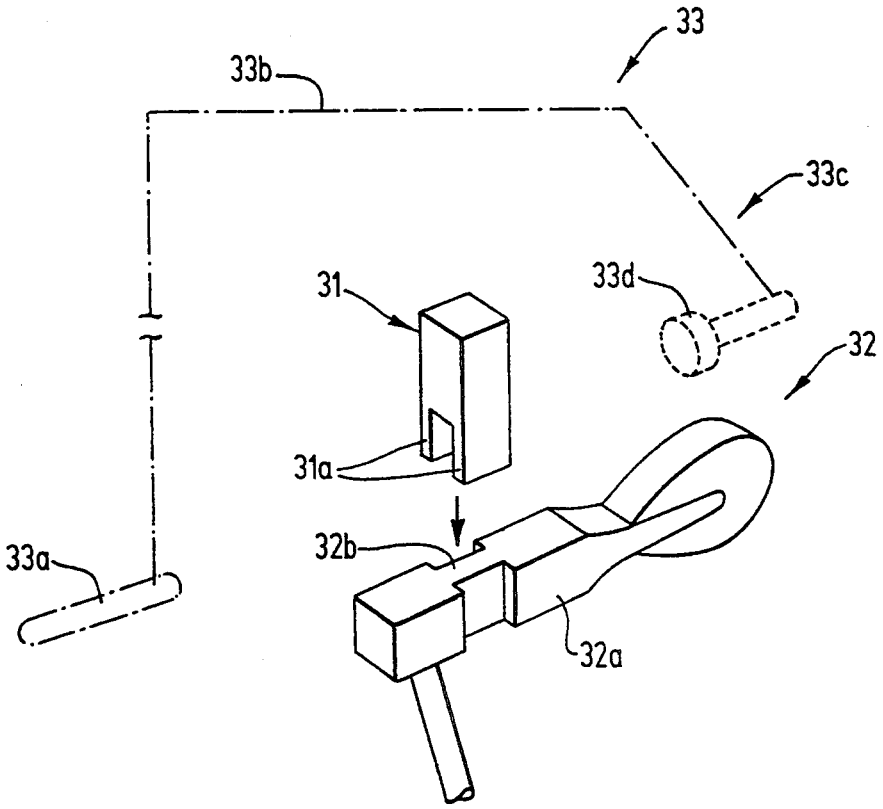
FIG. 7 is a perspective view showing a detachable bracket member separated from a hammer wood incorporated in still another keyboard instrument according to the present invention.

Turning to FIG. 7 of the drawings, a detachable bracket member 31 is separated from a hammer head 32 incorporated in still another keyboard instrument embodying the present invention. The keyboard instrument implementing the fourth embodiment largely comprises an acoustic piano, a silent system 33 and an electronic sound generating system (not shown), and selectively enters into a mechanical sound producing mode and an electronic sound producing mode.

The acoustic piano and the electronic sound generating system are similar to those of the second embodiment, and no further description is incorporated hereinbelow for the sake of simplicity.

The silent system 33 largely comprises a pedal 33*a*, a link mechanism 33*b* and a hammer stopper 33*c*. The pedal 33*a* is manipulated by a player, and is caught by a suitable retainer on a board member incorporated in the acoustic piano for keeping it at manipulated state. The link mechanism 33*b* is connected between the pedal 33*a* and the hammer stopper 33*c*, and causes the hammer stopper 33*c* to change the position.

Namely, while the pedal 33*a* is in the manipulated state, the link mechanism 33*b* changes the hammer stopper 33*c* from a free position to a blocking position, and the hammer stopper 33*c* blocks the strings from the hammer heads 32 as will be described in detail hereinlater.

On the other hand, when the pedal 33*a* is released from the manipulated position, the link mechanism 33*b* allows the hammer stopper 33*c* to return from the blocking position to the free position, and the hammer heads 32 strike the associated strings without interruption of the hammer stopper 33*c*.

The hammer stopper 23*c* has a plurality of detachable bracket members 31 bolted to hammer woods 32*a* and a plurality of stoppers 33*d* driven by the link mechanism 33*b*. Each of the detachable bracket members 31 has a bifurcated lower end portion 31*a*, and the hammer wood 22*a* is partially narrowed. The narrow portion 32*b* is snugly received into the bifurcated lower end portion 31*a*, and the detachable bracket member 31 radially outwardly projects from the hammer wood 32*a*. The detachable bracket member 31 is fixed to the hammer wood 32*a* without any screw, and rotates together therewith.

Figure 8:
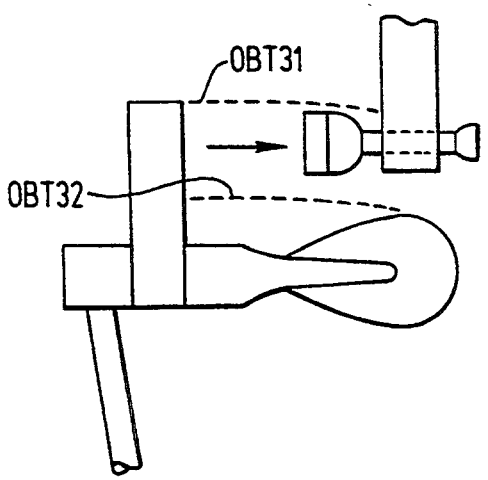
FIG. 8 is a side view showing the bracket member attached to the hammer wood.

The leading ends of the detachable bracket members 31 respectively trace orbits OBT31 while the hammer heads 3 rotate toward the strings along the orbits OBT32 as shown in FIG. 8. The blocking position of the hammer stopper 33c is between the orbits OBT32 of the hammer heads 32 and the orbits OBT31 of the detachable bracket members 31. 0n the other hand, the free position is outof the orbits OBT31, and not only the hammer heads 32 but also the detachable bracket members 31 are not brought into contact with the stoppers 33d in the free position.

The behavior of the keyboard instrument implementing the third embodiment is similar in both mechanical and electronic sound producing modes to the first and second embodiments, and an upright piano is remodeled to the keyboard instrument implementing the fourth embodiment through a method similar to the second embodiment. In the remodeling method, the hammer woods 32a are partially cut away for forming the narrow portion 32b, and the detachable bracket members 31 are fixed to the hammer woods 32a. Although the hammer woods 32a of an upright piano are machined, any screw is not required for the detachable bracket members 31.

Fifth Embodiment

Figure 9:
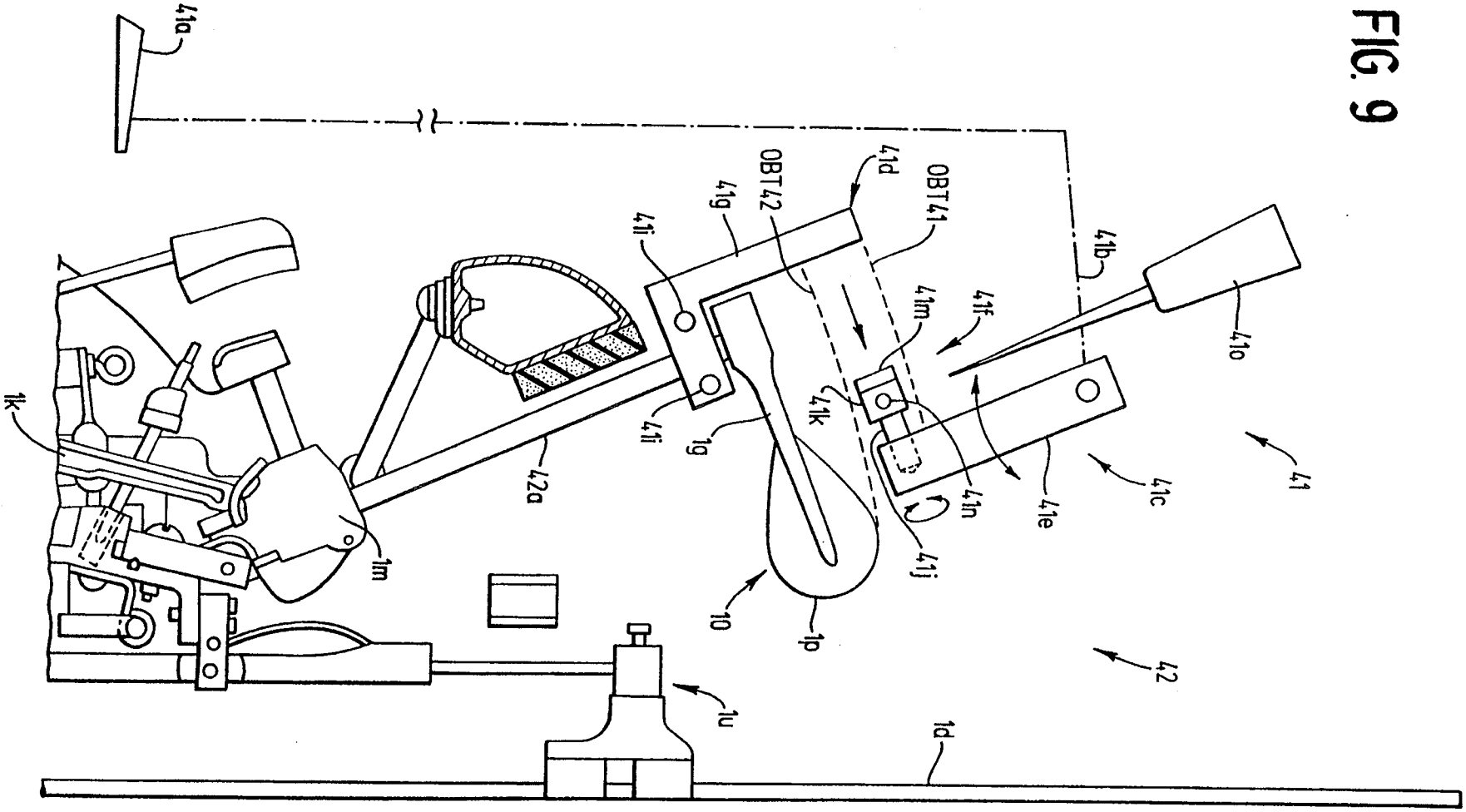
FIG. 9 is a side view showing a silent system incorporated in a keyboard instrument according to the present invention.

Turning to FIG. 9 of the drawings, a silent system 41 is incorporated in another keyboard instrument embodying the present invention. The keyboard instrument implementing the fifth embodiment largely comprises the silent system 41, an acoustic piano 42 and an electronic sound generating system (not shown), and selectively enters into a mechanical sound producing mode and an electronic sound producing mode.

The acoustic piano 42 is of the upright type, and is similar to the acoustic piano 1 except for hammer shanks 42a. For this reason, the other component parts are labeled with the references designating the corresponding parts of the acoustic piano 1 without detailed description. In this instance, the hammer shanks 42a are inserted to the hammer woods 1q as similar to the second embodiment.

The electronic sound generating system is similar to that of the first embodiment, and no further description is incorporated hereinbelow for the sake of simplicity.

The silent system 41 largely comprises a pedal 41a, a link mechanism 41b and a hammer stopper 41c. The pedal 41a is manipulated by a player, and is caught by a step portion of a board (not shown) incorporated in the acoustic piano 42 for keeping at manipulated state. The link mechanism 41b is connected between the pedal 41a and the hammer stopper 41c, and causes the hammer stopper 41c to change the position.

Namely, while the pedal 41a is in the manipulated state, the link mechanism 41b changes the hammer stopper 41c from a free position to a blocking position, and the hammer stopper 41c blocks the strings from the hammer heads 1o as will be described in detail hereinlater.

On the other hand, when the pedal 41a is released from the manipulated position, the link mechanism 41b allows the hammer stopper 41c to return from the blocking position to the free position, and the hammer heads 1o strike the associated strings 1d without interruption of the hammer stopper 41c.

The hammer stopper 41c comprises a plurality of detachable bracket members 41d fixed to the hammer shanks 42a, a stopper rail 41e connected with the link mechanism 41b and a plurality of stoppers 41f supported by the stopper rail 41e.

Figure 10:
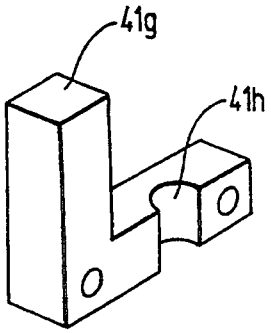
FIG. 10 is a perspective view showing a part of a detachable bracket member of the silent system.
Figure 11:
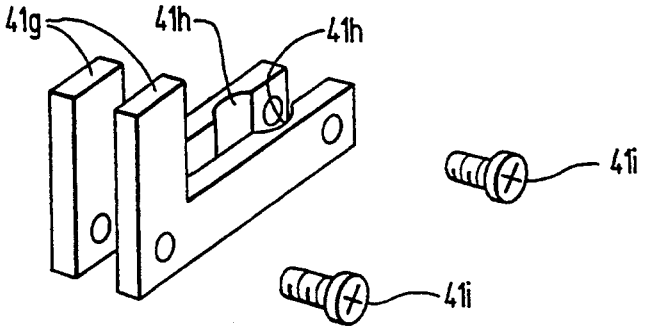
FIG. 11 is a perspective view showing the detachable bracket member in disassembled state.

Each of the detachable bracket members 41d is implemented by a pair of generally L-shaped brackets 41g, and a recess 41h is formed in each of the generally L-shaped brackets 41g as shown in FIG. 10. Each of the hammer shanks 42a is sandwiched between the pair of generally L-shaped brackets 41g, and bolts 41i and nuts (not shown) fix the generally L-shaped brackets 41g to a leading end portion of the hammer shank 42a. As a result, the detachable bracket members 41d radially outwardly project from the hammer woods 1q, and respectively trace orbits OBT41 while the hammer heads 1o rotate toward the strings 1d along the orbits OBT42. There is the blocking position of the hammer stopper 41c between the orbits OBT42 of the hammer heads 1o and the orbits OBT41 of the detachable bracket members 41d. On the other hand, the free position of the hammer stopper 41d is outof the orbits OBT41, and not only the hammer mechanisms 1c but also the detachable bracket members 41d are not brought into contact with the stoppers 41f.

Each of the stoppers 41f comprises a threaded stem portion 41j engaged with a female screw formed in the stopper rail 41e, a head portion 41k integral with the threaded stem portion 41j and a cushion member 41m attached to the head portion 41k. A hole 41n is formed in the head portion 41k, and the threaded stem portion 41j is turnable by means of a tool 41o inserted into the hole 41n, thereby regulating the distance between the detachable bracket members 41d and the cushion members 41m to predetermined values as similar manner to the first embodiment. In this instance, the silent system 11 serves as a controlling system, and the detachable bracket members 41d as extensions.

The behavior of the keyboard instrument implementing the fifth embodiment is similar in both mechanical and electronic sound producing modes to the first embodiment, and the remodeling work is analogous to the second embodiment. For this reason, description on the behavior and the remodeling work are omitted for avoiding repetition.

As will be appreciated from the foregoing description, hammer stopper according to the present invention blocks the strings from the hammer heads without sacrifice of the key-touch, and pianos are easily remodeled into the keyboard instrument according to the present invention by using the extensions.

Although particular embodiments of the present invention have been shown and described, it will be obvious to those skilled in the art that various changes and modifications may be made without departing from the spirit and scope of the present invention. For example, the link mechanism 2c may be manipulated by a hand of the player, and the rotatable stopper 2b may be shifted by an electric motor or a solenoid-operated actuator. Moreover, each of the stoppers 2e may be shared between a several hammer mechanisms, and a grand piano is available as the acoustic piano.

What is claimed is:

1. A keyboard instrument selectively entering a mechanical sound producing mode and an electronic sound producing mode, comprising:

a) an acoustic piano including a-1) a keyboard having a plurality of keys turnable with respect to a stationary board member, said plurality of keys being selectively depressed in both mechanical and electronic sound producing modes by a player, a-2) a plurality of key action mechanisms respectively coupled with said plurality of keys, and selectively actuated by said plurality of keys when said player depresses, a-3) a plurality of hammer mechanisms respectively associated with said plurality of key action mechanisms, and having respective hammer shanks and respective hammer heads projecting from leading end portions of said hammer shanks substantially in normal with respect to said hammer shanks, respectively, said plurality of key action mechanisms being driven for rotation by said plurality of key action mechanisms when said player selectively depresses said plurality of keys, and a-4) a plurality of strings associated with said plurality of hammer mechanisms, and struck by said hammer heads in said mechanical sound producing mode when the player selectively depresses said plurality of keys;

b) an electronic sound producing means deciding what keys are depressed by said player in said electronic sound producing mode, and operative to electronically produce sounds corresponding to the keys depressed by said player; and c) a controlling means having a plurality of extensions radially outwardly extending with respect to the leading end portions of said shammer shanks, respectively, a movable stopper moved into and outof orbits of said extensions, and a driver unit responsive to an instruction of said player for driving said movable stopper between a free position in said mechanically sound producing mode and a blocking position in said electronically sound producing mode, said extensions being freely moved together with the associated hammer mechanisms without an interruption of said movable stopper while said movable stopper is staying in said free position, said extensions being brought into contact with said movable stopper in said blocking position before the associated hammer heads strike said plurality of strings.

2. The keyboard instrument as set forth in claim 1, in which said extensions are respectively integral with said hammer shanks.

3. The keyboard instrument as set forth in claim 1, in which each of said extensions is implemented by a detachable bracket member fixed to one of said hammer heads.

4. The keyboard instrument as set forth in claim 3, in which said detachable bracket member is bolted to an upper surface of said hammer head.

5. The keyboard instrument as set forth in claim 3, in which said detachable bracket member has a bifurcated lower portion into which a narrow portion of said hammer head is snugly received.

6. The keyboard instrument as set forth in claim 3, in which said detachable bracket member has a pocket portion into which a hammer wood of said hammer head is partially received, said pocket portion and said hammer wood are fixed by means of a bolt member.

7. The keyboard instrument as set forth in claim 1, in which each of said extensions is implemented by a detachable bracket member fixed to a leading end portion of one of said hammer shanks.

8. The keyboard instrument as set forth in claim 7, in which said detachable bracket member is implemented by a pair of brackets sandwiching said leading end portion.

9. The keyboard instrument as set forth in claim 7, bolt means press said pair of brackets to said leading end portion.

10. The keyboard instrument as set forth in claim 1, in which said movable stopper is implemented by a plurality of stoppers respectively associated with said extensions, each of said plurality of stoppers being regulable in such a manner as that the associated extension is brought into contact therewith between an escape of a jack of the associated key action mechanism from a butt of the associated hammer mechanism and a strike of the associated hammer head at the associated strings.

11. The keyboard instrument as set forth in claim 10, in which each of said plurality of stoppers comprises a threaded portion engaged with a female screw formed in a supporting member driven by said driver unit, a head portion integral with said threaded portion and a cushion member attached to said head portion, said threaded portion being turnable for changing a distance between said supporting member and said cushion member.

12. The keyboard instrument as set forth in claim 1, in which said driver unit comprises a pedal manipulated by said player and a link mechanism connected between said pedal and said movable stopper.

13. A keyboard instrument selectively entering a mechanical sound producing mode and an electronic sound producing mode, comprising:

a) an acoustic piano including a-1) a keyboard having a plurality of keys turnable with respect to a stationary board member, said plurality of keys being selectively depressed in both mechanical and electronic sound producing modes by a player, a-2) a plurality of key action mechanisms respectively coupled with said plurality of keys, and having respective jacks, said plurality of key action mechanisms being selectively actuated by said plurality of keys when said player depresses, a-3) a plurality of hammer mechanisms having respective butts respectively associated with said jacks, respective hammer shanks respectively projecting from said butt and respective hammer heads projecting from leading end portions of said hammer shanks substantially in normal with respect to said hammer shanks, respectively, each of said jacks being escaped from the associated butt for rotating the associated hammer head when said player depresses the associated key, and a-4) a plurality of strings struck by said hammer heads in said mechanical sound producing mode when the player selectively depresses said plurality of keys;

b) an electronic sound producing means deciding what keys are depressed by said player in said electronic sound producing mode, and operative to electronically produce sounds corresponding to the keys depressed by said player; and c) a silent means having a plurality of extensions radially outwardly extending with respect to said hammer heads, respectively, a movable stopper moved into and outof orbits of said extensions, a pedal means manipulated by said player, a link mechanism connected between said peal means and said movable stopper for changing said movable stopper between a free position in said mechanically sound producing mode and a blocking position in said electronically sound producing mode, said extensions being freely moved together with the associated hammer mechanisms without an interruption of said movable stopper while said movable stopper is staying in said free position, each of said extensions being brought into contact with said movable stopper in said blocking position between an escape of said jack from said butt and a strike of the associated hammer head at the associated strings, said movable stopper being protectable and retractable for regulating timings when said extensions are brought into contact therewith.

14. A keyboard instrument selectively entering a mechanical sound producing mode and an electronic sound producing mode, comprising:

a) an acoustic piano including a-1) a keyboard having a plurality of keys turnable with respect to a stationary board member, said plurality of keys being selectively depressed in both mechanical and electronic sound producing modes by a player, a-2) a plurality of key action mechanisms respectively coupled with said plurality of keys, and having respective jacks, said plurality of key action mechanisms being selectively actuated by said plurality of keys when said player depresses, a-3) a plurality of hammer mechanisms having respective butts respectively associated with said jacks, respective hammer shanks respectively projecting from said butt and respective hammer heads projecting from leading end portions of said hammer shanks substantially in normal with respect to said hammer shanks, respectively, each of said jacks being escaped from the associated butt for rotating the associated hammer head when said player depresses the associated key, and a-4) a plurality of strings struck by said hammer heads in said mechanical sound producing mode when the player selectively depresses said plurality of keys;

b) an electronic sound producing means deciding what keys are depressed by said player in said electronic sound producing mode, and operative to electronically produce sounds corresponding to the keys depressed by said player; and c) a silent means having a plurality of detachable bracket members radially outwardly extending with respect to said hammer heads, respectively, a movable stopper moved into and outof orbits of said detachable bracket members, a pedal means manipulated by said player, a link mechanism connected between said peal means and said movable stopper for changing said movable stopper between a free position in said mechanically sound producing mode and a blocking position in said electronically sound producing mode, said detachable bracket members being freely moved together with the associated hammer mechanisms without an interruption of said movable stopper while said movable stopper is staying in said free position, each of said detachable bracket member being brought into contact with said movable stopper in said blocking position between an escape of said jack from said butt and a strike of the associated hammer head at the associated strings, said movable stopper being protectable and retractable for regulating timings when said detachable bracket members are brought into contact therewith.

15. A method of remodeling a piano into a keyboard instrument selectively entering into a mechanically sound producing mode and an electronically sound producing mode, comprising the steps of:

a) preparing a piano which comprises a keyboard having a plurality of keys turnable with respect to a stationary board member, said plurality of keys being selectively depressed in both mechanical and electronic sound producing modes by a player, a plurality of key action mechanisms respectively coupled with said plurality of keys, and selectively actuated by said plurality of keys when said player depresses, a plurality of hammer mechanisms respectively associated with said plurality of key action mechanisms, and having respective hammer shanks and respective hammer heads projecting from leading end portions of said hammer shanks substantially in normal with respect to said hammer shanks, respectively, said plurality of key action mechanisms being driven for rotation by said plurality of key action mechanisms when said player selectively depresses said plurality of keys, and a plurality of strings associated with said plurality of hammer mechanisms, and struck by said hammer heads in said mechanical sound producing mode when the player selectively depresses said plurality of keys; and b) adding an electronic sound producing means and a controlling means, said electronic sound producing means being operative to decide what keys are depressed by said player in said electronic sound producing mode for electronically producing sounds corresponding to the keys depressed by said player, said controlling means having a plurality of extensions attached to said plurality of hammer mechanisms in such a manner as to radially outwardly project therefrom, a movable stopper moved into and outof orbits of said extensions, and a driver unit responsive to an instruction of said player for driving said movable stopper between a free position in said mechanically sound producing mode and a blocking position in said electronically sound producing mode, said extensions being freely moved together with the associated hammer mechanisms without an interruption of said movable stopper while said movable stopper is staying in said free position, said extensions being brought into contact with said movable stopper in said blocking position before the associated hammer heads strike said plurality of strings.

* * * * *